United States Patent [19]

Fowler et al.

[11] Patent Number: 4,625,084

[45] Date of Patent: Nov. 25, 1986

[54] ROTARY SWITCH CONSTRUCTION AND METHOD OF MAKING THE SAME

[75] Inventors: Daniel L. Fowler, Kentwood, Mich.; John W. Froeb, Riverside, Ill.

[73] Assignee: Robertshaw Controls Company, Richmond, Va.

[21] Appl. No.: 676,440

[22] Filed: Nov. 29, 1984

[51] Int. Cl.[4] ..... H01H 19/58

[52] U.S. Cl. ..... 200/11 DA; 29/622; 200/11 G

[58] Field of Search ..... 29/622; 200/11 D, 11 DA, 200/11 TW, 11 R, 11 A, 11 G, 11 K

[56] References Cited

U.S. PATENT DOCUMENTS 3,809,830 5/1974 Lockard et al. ..... 200/11 TW

*Primary Examiner*—A. D. Pellinen

*Assistant Examiner*—Morris Ginsburg

*Attorney, Agent, or Firm*—Candor, Candor & Tassone

[57] ABSTRACT

A rotary switch construction and method of making the same are provided, the switch construction comprising a surface unit having a substantially circular electrically conductive code pattern thereon, and electrically conductive wiper contact unit cooperating with the surface unit for making contact with a selected part of the pattern, and a rotary selector operatively associated with the units for selecting the desired part of the pattern that is to be contacted by the wiper contact unit, the wiper contact unit comprising a first pair of electrically connected wiper contacts disposed to respectively contact the pattern on a first substantially circular path thereof at points thereon that are disposed approximately 180° from each other.

20 Claims, 14 Drawing Figures

ROTARY SWITCH CONSTRUCTION AND METHOD OF MAKING THE SAME

BACKGROUND OF THE INVENTION

1. Field of the Invention

This invention relates to a new rotary switch construction as well as to a method of making such a rotary switch construction.

2. Prior Art Statement

It is known to provide a rotary switch construction comprising a surface means having a substantially circular electrically conductive code pattern thereon, an electrically conductive wiper contact means cooperating with the surface means for making contact with a selected part of the pattern, and a rotary selector operatively associated with the means for selecting the desired part of the pattern that is to be contacted by the wiper contact means. For example, see FIGS. 13 and 14 of this application and the copending patent application of Daniel L. Fowler, one of the applicants of this invention, Ser. No. 433,684, filed Oct. 12, 1982, now issued on Feb. 4, 1986 as U.S. Pat. No. 4,568,927 and published on Apr. 23, 1984 as European Patent Application Publication No. 0,109,182.

It is also known to form part of the wiper contact means of such a rotary switch construction to comprise two side-by-side electrically connected wiper contacts to respectively contact the conductive pattern at adjacent points thereon. For example, see FIG. 14 of this application.

SUMMARY OF THE INVENTION

It is a feature of this invention to provide a new rotary switch construction wherein the adverse effects provided by the problems of contact bounce and contact electrical noise and/or contact resistance variations are reduced.

In particular, it was found according to the teachings of this invention that in the prior known rotary switch construction the wiper contact means thereof tended to bounce when the same was moved across the code pattern to make and break therewith and the contact resistance variations as the wiper contact means moved across the conductive code pattern provided contact electrical noise.

However, it was found according to the teachings of this invention that the adverse effects of such contact bounce and contact resistance variations could be reduced if each wiper contact comprised a pair of electrically connected wiper contacts that respectively contact a substantially circular code pattern on a substantially circular path thereof at points thereon that are disposed approximately 180° from each other as this provides a parallel switching function.

It was also found according to the teachings of this invention that with such an arrangement, code dropouts have been almost eliminated, i.e., the problem of where continuity is momentarily interrupted due to the inability of the prior known wiper contact to dynamically track irregularities in the code track surface.

For example, one embodiment of this invention provides a rotary switch construction comprising a surface means having a substantially circular electrically conductive code pattern thereon, an electrically conductive wiper contact means cooperating with the surface means for making contact with a selected part of the pattern, and a rotary selector operatively associated with the surface means and the wiper contact means for selecting the desired part of the pattern that is to be contacted by the wiper contact means, the wiper contact means comprising a first pair of electrically connected wiper contacts disposed to respectively contact the code pattern on a first substantially circular path thereof at points thereon that are disposed approximately 180° from each other, a second pair of electrically connected wiper contacts disposed to respectively contact the pattern on a second substantially circular path thereof at points thereon that are disposed approximately 180° from each other, and a third pair of electrically connected wiper contacts disposed to respectively contact the pattern on a third circular path thereof at points that are disposed approximately 180° from each other, the wiper contact means comprising a body portion, each wiper contact having opposed ends one of which is connected to the body portion and the other of which engages the code pattern, each wiper contact of the respective pair thereof extending from the body portion in a direction substantially opposite to the extending direction of the other wiper contact of that respective pair thereof, the other ends of the wiper contacts being substantially aligned on a diameter of the circular code pattern with one of the pairs of wiper contacts having each wiper contact thereof extending in a direction substantially opposite to the extending direction of the wiper contacts of the other pairs thereof that are disposed on the same side of the diameter of the circular code pattern therewith.

Accordingly, it is an object of this invention to provide a new rotary switch construction having one or more of the novel features of this invention as set forth above or hereinafter shown or described.

Another object of this invention is to provide a method of making such a rotary switch construction, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENTS

Figure 2:
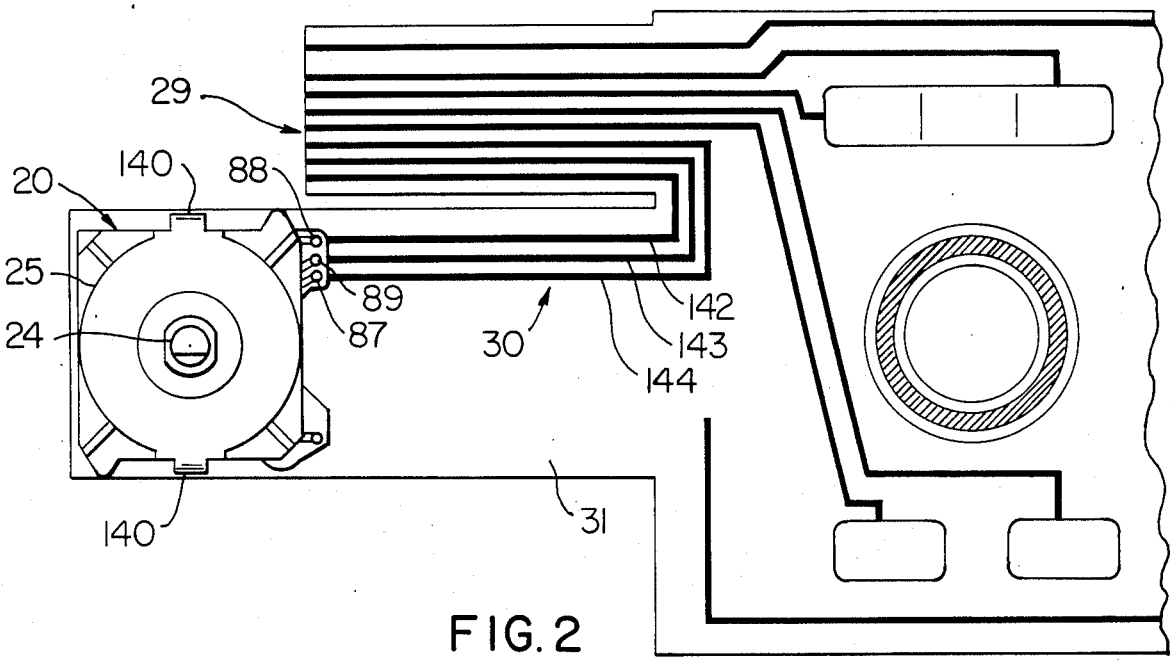
FIG. 2 is a fragmentary front view of the rotary switch construction of FIG. 1 mounted to a circuit board means.

While the various features of this invention are hereinafter illustrated and described as being particularly adapted to provide a rotary switch construction to provide a rotary entry means to increment and decrement data into a microprocessor-based control system for controlling appliances such as microwave ovens, dishwashers, washing machines, television sets and other appliances, it is to be understood that the various features of this invention can be utilized singly or in various combinations thereof to provide a rotary switch construction for controlling other apparatus as desired.

Therefore, this invention is not to be limited to only the embodiments illustrated in the drawings, because the drawings are merely utilized to illustrate one of the wide variety of uses of this invention.

Figure 1:
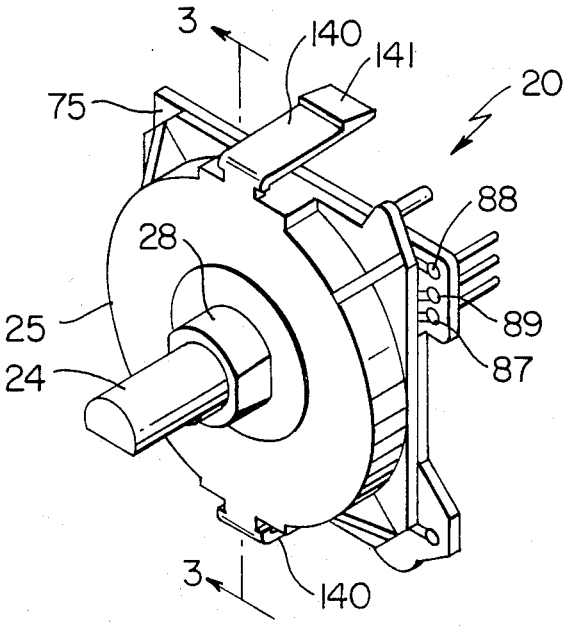
FIG. 1 is a perspective view of the rotary switch construction of this invention.
Figure 3:
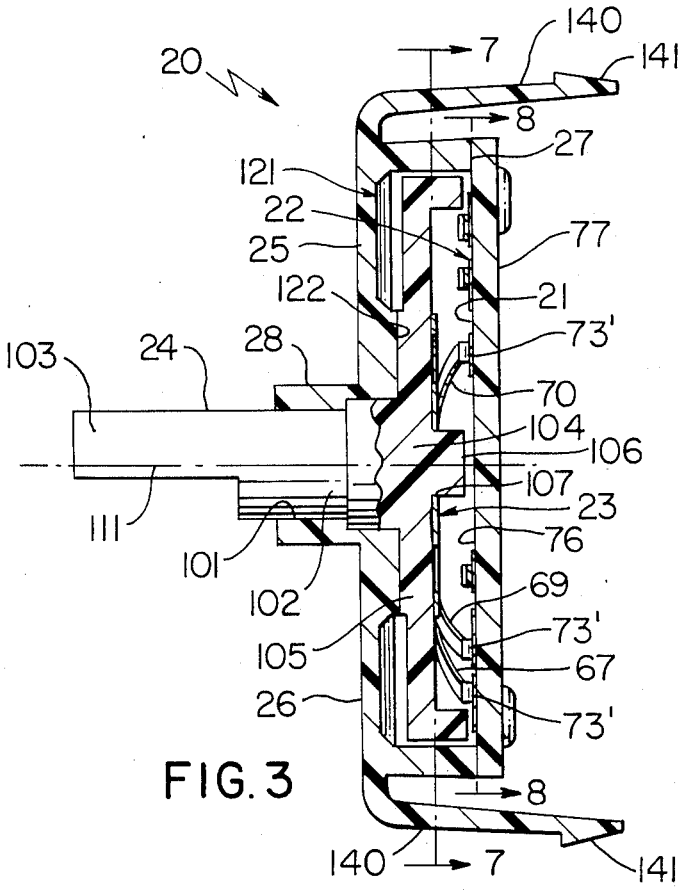
FIG. 3 is an enlarged cross-sectional view taken on line 3—3 of FIG. 1.

Referring now to FIGS. 1, 2 and 3, the new rotary switch construction of this invention is generally indicated by the reference numeral 20 and comprises a surface means 21 having a substantially circular electrically conductive code pattern 22 thereon, an electrically conductive wiper contact means 23 cooperating with the surface means 21 for making contact with a selected part of the pattern 22 in a manner hereinafter set forth, a rotary selector 24 operatively associated with the surface means 21 and wiper contact means 23 for selecting the desired part of the pattern 22 that is to be contacted by the wiper contact means 23 in a manner hereinafter set forth, and a cup-shaped housing member 25 that has a closed end 26 and an open end 27, the surface means 21 being secured to the housing member 25 in a manner hereinafter set forth and closing the open end 27 thereof.

The housing member 25 is formed of any suitable electrically insulating material and has means 28 that rotatably mounts the rotary selector 24 thereto, the rotary selector 24 also being formed of any suitable electrically insulating material and being operatively interconnected to the wiper contact means 23 to rotate the same relative to the surface means 21 as the wiper contact means 23 is disposed in the housing member 25 intermediate the closed end 26 thereof and the surface means 21.

The wiper contact means 23 is formed of any suitable electrically conductive material and is adapted to cooperate with the code pattern 22 to increment and decrement information in a digital manner through the electrical switching operation thereof to supply such data to a control system, such as the control system that is generally indicated by the reference numeral 29 in FIG. 2 and comprises a printed conductive circuit means 30 being carried by an insulating board means 31.

For example, the control system 29 can comprise the control system set forth in the aforementioned copending patent application of Daniel L. Fowler, Ser. No. 433,684, filed Oct. 12, 1982, now issued on Feb. 4, 1986, as U.S. Pat. No. 4,568,927 and also published as European Patent Application Publication No. 0,109,182 on Apr. 23, 1984 whereby this copending patent application is being incorporated into this application by this reference thereto.

Therefore, since such copending patent application fully sets forth the utility of a rotary switch construction and the full operation thereof further details of the system 29 and how the rotary switch construction 20 would operate therewith will not be described.

Figure 13:
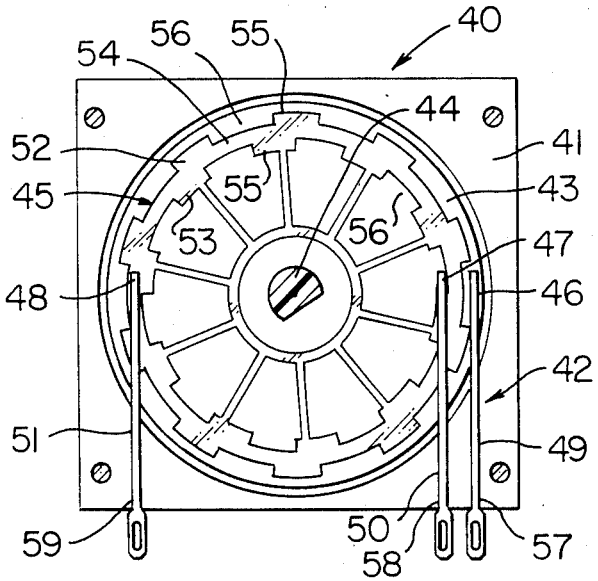
FIG. 13 PRIOR ART
FIG. 13 is a view similar to FIG. 7 and illustrates the prior known rotary switch construction of the aforementioned copending patent application, Ser. No. 433,684, filed Oct. 12, 1982 now issued on Feb. 4, 1986 as U.S. Pat. No. 4,568,927.

However, it is believed that in order to fully understand the unique features of the rotary switch construction 20 of this invention, the details of the prior known rotary switch construction should be reviewed, and, therefore, reference is now made to FIG. 13 wherein the rotary switch of such copending patent application is illustrated and is generally indicated by the reference numeral 40, the prior known rotary switch 40 comprising a stationary housing means 41 carrying the wiper contact means 42 and a surface means 43 that is adapted to be rotated relative to the housing means 41 and wiper contact means 42 by a rotary selector 44 operatively interconnected to the surface means 43. The surface means 43 has a substantially circular conductive code pattern 45 thereon that is adapted to be contacted by the contact ends 46, 47 and 48 of the wiper contacts 49, 50 and 51 which comprise the wiper contact means 42 thereof.

The conductive code pattern 45 has three concentrically disposed circular paths or tracks 52, 53 and 54 with the path 54 being continuous throughout its circular length whereas the paths 52 and 53 respectively have conductive portions 55 and non-conductive portions 56 disposed in a serial arrangement along the paths thereof with the conductive portions 55 of the path 52 leading the conductive portions 55 of the path 53 in a clockwise direction as illustrated.

The wiper contacts 49, 50 and 51 respectively have the other ends 57, 58 and 59 thereof secured to the housing means 41, the wiper contacts 49, 50 and 51 being formed of metallic material and being bent so that the ends 46, 47 and 48 thereof are disposed in contact with the code pattern 45 with a spring force whereby the ends 46, 47 and 48 wipe across the code pattern 45 as the surface means 43 is rotated relative thereto by the rotary selector 44.

The ends 46 and 47 of the wiper contacts 49 and 50 are disposed to respectively be in engagement with the paths or tracks 52 and 53 of the code pattern 45 while the end 48 of the wiper contact 51 is disposed to be in wiping contact with the path or track 54 of the code pattern 45. Thus, the wiper contact 51 is a common wiper contact as it is always in electrical contact with the code pattern 45 whereas the wiper contacts 49 and 50 are respectively disposed in contact and out of contact with the conductive portions 55 of the respective paths 52 and 53 depending upon the rotary position of the surface means 43 relative to the wiper contact means 42. In this manner, an electrical switching function is provided to electrically connect the common wiper contact 51 to the wiper contact 49 when the end 46 thereof is disposed in wiping contact with one of the conductive portions 55 of the path 52 and an electrical switching function is provided to electrically disconnect the common wiper contact 51 from the wiper contact 49 when that conductive portion 55 of the path 52 moves out of contact with the end 46 of the terminal 49 and a nonconductive portion 56 of the path 52 of the code pattern 45 is disposed thereagainst as illustrated in FIG. 13. Likewise, an electrical switching function is provided between the common wiping contact 51 and the wiping contact 50 as the same are electrically interconnected together when the end 47 of the wiper contact 50 is disposed in contact with a conductive portion 55 of the path 53 of the code pattern 45 and a breaking of that electrical connection between the common wiper contact 51 and the wiper contact 50 takes place when that conductive part 55 of the path 53 of the code pattern 45 moves out of contact with the end 47 of the wiper contact 50 and has a nonconductive portion 56 of the path 53 disposed against the end 47 of the wiper contact 50.

As previously stated, such making and breaking of the electrical contact between the common wiper contact 51 and the wiper contacts 49 and 50 can be utilized to increment and decrement data into a microprocessor of the control system 29 for controlling an appliance such as a microwave oven, dishwasher, washing machine, television set or other appliance as set forth in the aforementioned copending patent application.

However, it was found that through irregularities in the code pattern 45 and the placement of the end 48 of the common terminal 51 of the rotary switch 40 on that code pattern 45, code dropouts are provided where continuity is momentarily interrupted due to the inability of the wiper contact 51 to dynamically track such irregularities in the surface of the code track or path 54. Such irregularities can also provide contact bounce.

Figure 14:
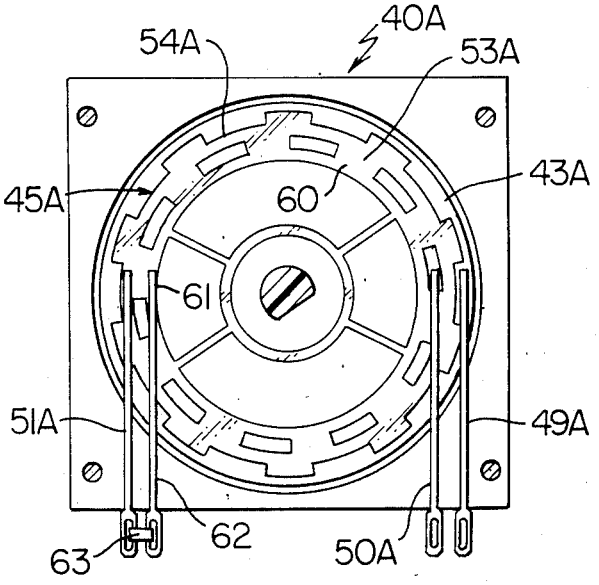
FIG. 14 PRIOR ART
FIG. 14 is a view similar to FIG. 13 and illustrates another prior art rotary switch construction that has been utilized in the same manner as the rotary switch construction of FIG. 13.

Accordingly, the rotary switch 40 of FIG. 13 was modified and such modified rotary switch construction is generally indicated by the reference numeral 40A in FIG. 14 wherein parts thereof similar to the rotary switch 40 are indicated by like reference numerals followed by the reference letter "A".

As illustrated in FIG. 14, the code pattern 45A on the rotatable surface means 43A of the rotary switch 40A was modified to include a fourth circular path or track 60 that is disposed inside the path or track 53A while being continuous and thereby providing a common path similar to the path 54A. An end 61 of another wiper contact 62 is disposed in engagement with the path 60 so that the two wiper contacts 51A and 62 are respectively always disposed in electrical contact with the code pattern 45A and are, in effect, electrically interconnected together in any suitable manner, such as by the electrical connection that is indicated by the reference numeral 63 in FIG. 14.

This prior known arrangement of providing two wiper contacts 51A and 62 for electrically connecting a power source (not shown) to the conductive portions of the code path 45A provides a parallel source of electrical interconnection to the conductive portion of the code pattern 45A so as to tend to reduce contact noise provided by irregularities in the conductive surface of the code pattern 45A in connection with the common wiper contacts therefor.

However, no such parallel switching function was provided for the wiper contacts 49A and 50A so that the problem of contact bounce and/or contact noise remained for the wiper contacts 49A and 50A of the rotary switch construction 40A.

It is believed that the wiper contact means 23 of the rotary switch construction 20 of this invention substantially reduces and/or eliminates the adverse effect of such contact bounce and/or contact noise for all of the wiper contacts thereof as will be apparent hereinafter whereby the details of the rotary switch construction 20 of this invention will now be described.

The wiper contact means 23 of the rotary switch construction 20 of this invention comprises a one-piece structure formed of metallic material and having a main body portion 65 and three pairs of wiper contacts formed integral therewith and extending therefrom in an arcuate manner.

In particular, the first pair of wiper contacts comprises the wiper contacts 66 and 67, the second pair of wiper contacts comprises the wiper contacts 68 and 69 and the third pair of wiper contacts comprises the wiper contacts 70 and 71.

Each wiper contact 66–71 has opposed ends 72 and 73, the ends 72 connecting the respective wiper contacts 66–71 to the body portion 65 of the wiper contact means 23 while the other ends 73 thereof are arcuately formed so as to have the convex sides 73' thereof engage against the code pattern 22 on the surface means 21 as will be apparent hereinafter.

Each wiper contact 66–71 has an arm or beam 74 interconnecting the opposed ends 72 and 73 together, each arm 66 being bowed or bent in a manner to provide a biasing or spring force urging the convex side 73' of the end 73 thereof against the surface means 21 so as to provide for good electrical contact between that end 73 and the code pattern 22 as will be apparent hereinafter. Each arm 74 of each wiper contact 66–71 is arcuate in the sense that it defines an arc that is adapted to be superimposed on a particular circular path of the code pattern 22 as will be apparent hereinafter.

Figure 7:
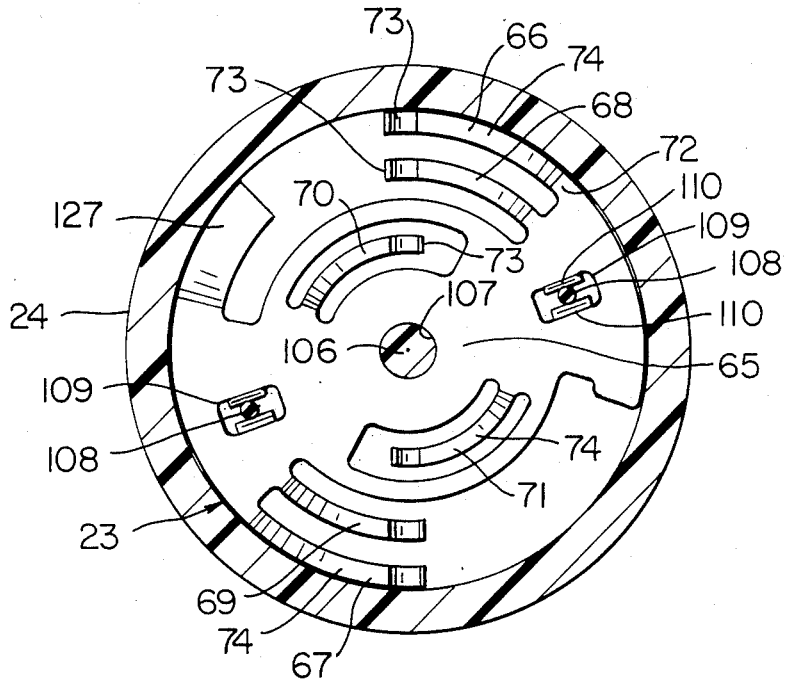
FIG. 7 is a cross-sectional view taken substantially on line 7—7 of FIG. 3.

While the wiper contact means 23 can be formed in any suitable manner, the same can comprise a stamping from a blank of metallic material and have the configuration illustrated in FIG. 7 wherein the third pair of wiper contacts 70 and 71 extend in opposite directions relative to the first pair of wiper contacts 66 and 67 and the second pair of wiper contacts 68 and 69.

Also, it can be seen that each pair of wiper contacts 66, 67; 68, 69 and 70, 71 have the contact ends 73 thereof disposed to respectively contact the code pattern 22 on respective substantially circular paths thereof at points thereon that are disposed approximately 180° from each other with the arms 74 of each pair extending in the opposite direction from the other arm 74 of that pair thereof for a purpose hereinafter set forth.

Figure 8:
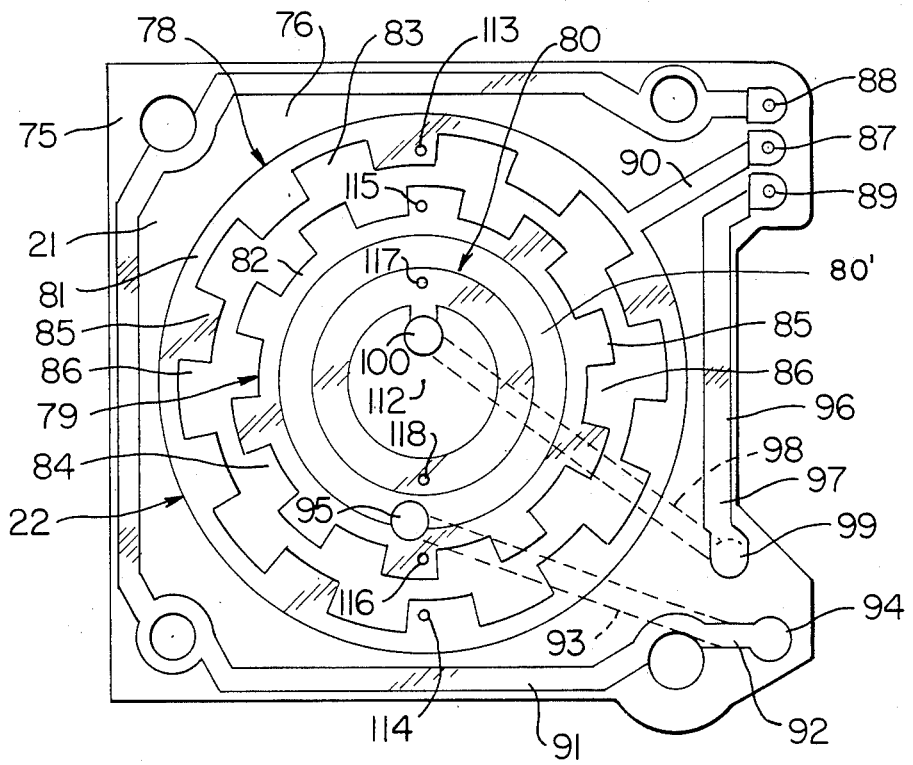
FIG. 8 is a cross-sectional view taken substantially on line 8—8 of FIG. 3.

The surface means 21 of the rotary switch construction 20 of this invention comprises a substantially rigid board means 75 formed of any suitable electrically insulating material and having opposed substantially flat sides 76 and 77, the code pattern 22 being disposed on the side 76 of the board 75 in any suitable manner and comprising three substantially circular and concentrically disposed, spaced apart paths or tracks that are generally indicated by the reference numerals 78, 79 and 80 as illustrated in FIG. 8.

The circular paths 78 and 79 each has a substantially circular continuous portion 81 and 82 and a discontinuous circular portion 83 and 84 respectively comprising a plurality of conductive segments 85 and nonconductive segments 86 in the serial arrangement illustrated in FIG. 8 whereas the circular path 80 of the code pattern 22 comprises a continuous circular conductive path.

The board means 75 has three electrically conductive terminal pins 87, 88 and 89 adapted to be respectively electrically interconnected to the circular paths 78, 79 and 80.

In particular, the terminal pin 87 is electrically interconnected to the path 79 by a conductive strip 90 disposed on the side 76 of the board 75.

The terminal 88 is electrically interconnected to the circular path 79 by a conductive strip 91 disposed on the side 76 of the board 75 and having an end 92 electrically interconnected to a conductive strip 93 disposed on the other side 77 of the board 75 by an electrical conductor 94 that extends through the board 75. The conductive strip 93 on the side 77 of the board 75 is, in turn, electrically interconnected to the circular path 79 by a conductor 95 that extends through the board 75 whereby the terminal 88 is electrically interconnected to the conductive code path 79.

The terminal 89 is electrically interconnected to the circular path 80 by a conductive strip 96 disposed on the side 76 of the board 75 and having its end 97 electrically interconnected to a strip 98 on the other side 77 of the board 75 by a conductor means 99 passing through the board 75. The conductive strip 98 is, in turn, electrically interconnected to the conductive circular path 80 by a conductor 100 passing through the board 75 as illustrated in FIG. 8.

It can be seen that the conductive projections 85 of the circular paths 78 and 79 are respectively offset relative to each other so that the same lead or trail each other in substantially the same manner as the conductive portions 55 of the paths 52 and 53 of the prior known rotary switch construction 40 and for the same purpose.

The cup-shaped housing means 25 of the rotary switch construction 20 of this invention has a stepped bore 101 passing through the closed end wall 26 thereof which telescopically receives a stepped shaft portion 102 of the rotary selector 24 as illustrated in FIG. 3 so as to rotatably mount the selector 24 thereto, the shaft means 102 having an end 103 for receiving a suitable control knob (not shown) and the other end 104 thereof comprising a disk-like part 105 that has a central reduced protrusion 106 adapted to be received through a circular opening 107 formed through the body portion 65 of the wiper contact means 23 as illustrated in FIGS. 3 and 7. The disk-like portion 105 of the selector 24 has a pair of outwardly extending projections 108, FIG. 7, that project through suitable slots 109 in the body portion 65 of the wiper contact means 23 so that rotation of the selector shaft 102 causes the wiper contact means 23 to rotate in unison therewith through the drive action of the projections 108 of the disk means 105 on suitable bent tangs 110 of the wiper contact means 23 that were formed during the stamping of the slot means 109 therethrough.

The rotary shaft 102 has an axis of rotation that is indicated by the reference numeral 111 in the drawings and that axis of rotation 111 substantially coincides with a center point 112 of the circular code pattern 22 so that the wiper contact means 23 is, in effect, rotated about the point 112 as will be apparent hereinafter.

When the wiper contact means 23 is assembled with the rotary selector 24 in the housing member 25, the bent wiper contacts 66–71 are placed under compression between the disk 105 of the selector 24 and the side 76 of the board 75 so that the ends 73 of the wiper contacts 66–71 have a spring force thereon urging the same into good electrical contact with the code pattern 22 and maintaining that electrical contact with the code pattern 22 as the wiper contact means 23 rotates relative thereto upon rotation of the selector shaft 102 relative to the housing member 25.

The ends 73 of the first pair of wiper contacts 66 and 67 are so constructed and arranged that the same respectively contact the circular portion 83 of the circular path 78 at points disposed approximately 180° from each other, such as represented by the points 113 and 114 in FIG. 8. Similarly, the second pair of wiper contacts 68 and 69 has the ends 73 thereof so constructed and arranged that the same contact the circular portion 84 of the circular path 79 at points thereon that are disposed approximately 180° from each other, such as represented by the points 115 and 116 in FIG. 8. Likewise, the third pair of wiper contacts 70 and 71 is so constructed and arranged that the ends 73 thereof contact the conductive portion 80' of the circular path 80 at points disposed approximately 180° from each other, such as represented by the points 117 and 118 in FIG. 8.

Therefore, it can be seen that the arms 74 of the first pair of wiper contacts 66 and 67 respectively define arcs that are substantially superimposed on the first circular path 78 at the circular portion 83 thereof and when rotated in a clockwise direction in FIG. 7 will be pulled across of the code pattern 22 whereas when rotated in a counterclockwise direction in FIG. 7 will be pushed across the code pattern 22.

Similarly, the arms 74 of the second pair of wiper contacts 68 and 69 define arcs that are adapted to be substantially superimposed on the circular portion 84 of the circular path 79 with the ends 73 thereof being simultaneously pushed or pulled across the code pattern 22 depending upon the direction of rotation of the wiper contact means 23.

Likewise, the arms 74 of the third pair of wiper contacts 70 and 71 define arcs that are substantially superimposed on the conductive circular portion 80' of the circular path 80 with the ends 73 thereof being disposed to be respectively pushed or pulled across the code pattern 22 depending upon the direction of rotation of the wiper contact means 23 except that the arm 74 of the wiper contact 70 extends in an opposite direction to the arms 74 of the wiper contacts 66 and 68 and the arm 74 of the wiper contact 71 extends in an opposite direction to the arms 74 of the wiper contacts 67 and 69.

In this manner, the arms 74 have been arranged such that two opposed sets of wiper contacts 66, 68 and 67, 69 are pulled across the surface 21 when the wiper contact means 23 is rotated in a clockwise direction in FIG. 7 while the opposed wiper contacts 70 and 71 are being pushed across the surface 21 whereas when the wiper contact means 23 is rotated in a counterclockwise direction in FIG. 7, the two opposed sets of wiper contacts 66, 68 and 67, 69 are pushed across the surface 21 while the opposed contacts 70 and 71 are pulled across the surface 21. It is believed that this wiper contact action results in similar dynamic contact response when the selector shaft 102 is turned or rotated in either a clockwise or counterclockwise direction.

In particular, the code pattern emitted by the rotary switch construction 20 of this invention is dynamically a function of shaft rotation as the wiper contacts make and break with their respective paths or tracks of the conductive code pattern. Such a mechanical interface has limitations and application issues that must be considered, such as contact bounce when contacts make and break with the conductive code pattern. Contact electrical noise which is contact resistance variations as the contact moves across the conductive code pattern is also an issue to be considered. The magnitude of these parameters have been greatly reduced in the rotary switch construction 20 of this invention. For example, a major improvement is inherent in the wiper contact means 23 thereof. The wiper contact means 23 provides two sets of wiper contacts 66, 67; 68, 69 and 70, 71 which simultaneously interface with the code pattern tracks or paths 78, 79 and 80 and this produces a parallel switching function that greatly reduces contact bounce. The parallel switching function is believed to also reduce electrical contact noise and/or contact resistance variation as the wiper contacts travel across the conductive surface of the code pattern tracks or paths 78, 79 and 80 whereby code dropouts have almost been eliminated. It is also believed that the length of each of the contact arms 74 of the wiper contacts 66–71 of the rotary switch construction 20 of this invention have about the same length and have the same contact force which results in similar dynamic contact response which has been optimized for low contact bounce and dynamic tracking of the code pattern surface to reduce such dropouts.

Figure 4:
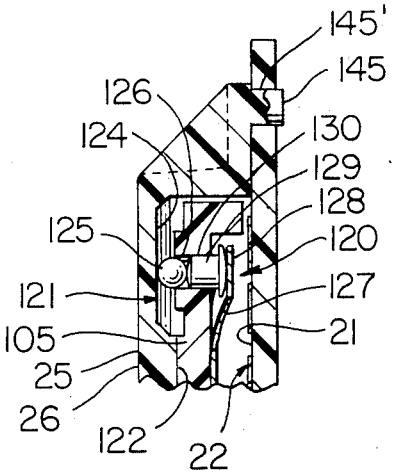
FIG. 4 is a fragmentary cross-sectional view illustrating the detent means of the rotary switch construction of FIGS. 1-3, FIG. 4 having been taken in a general direction as provided by the cross-sectional arrows 4—4 of FIG. 6.
Figure 5:
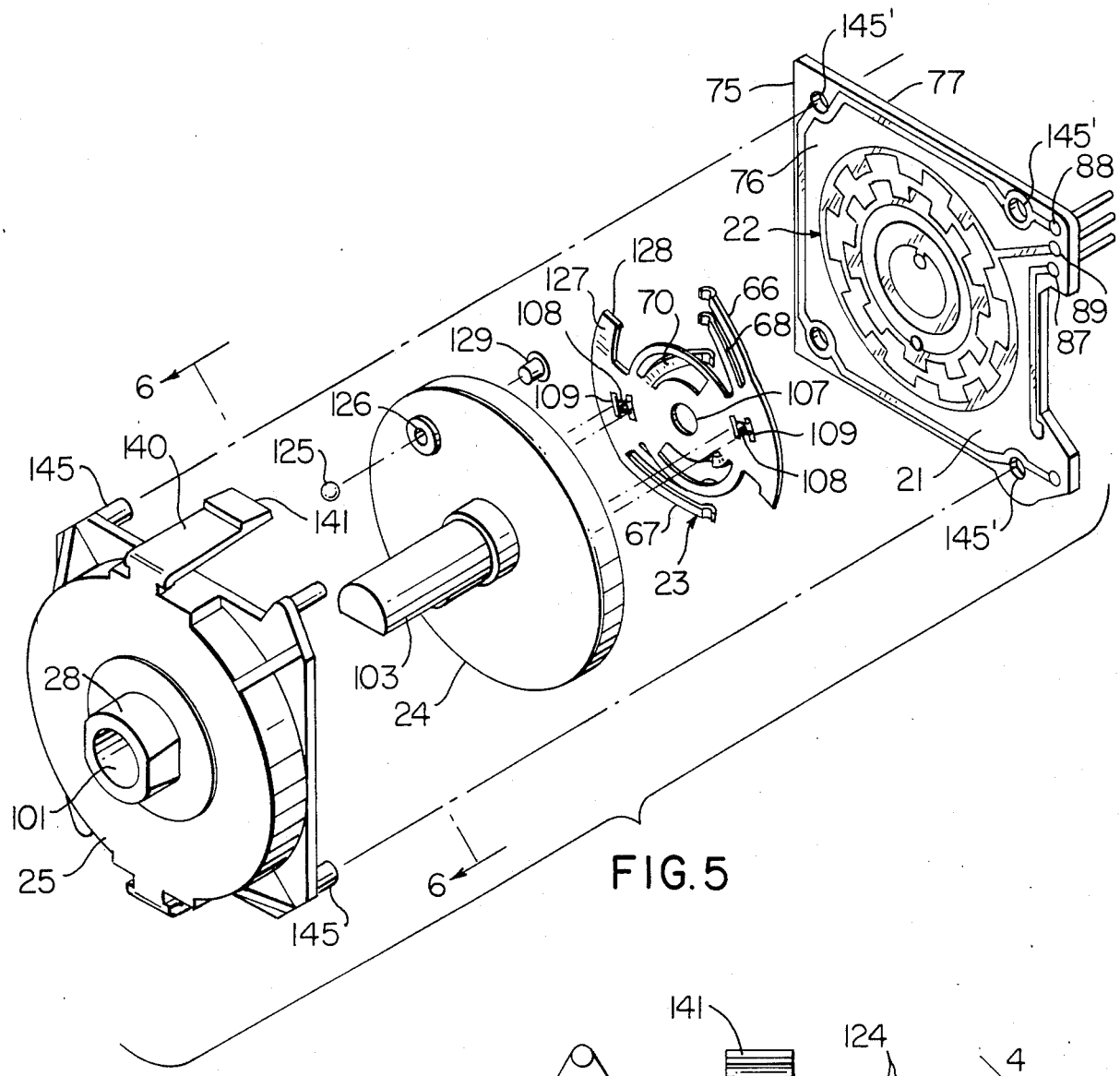
FIG. 5 is an exploded perspective view of the parts of the rotary switch construction of FIGS. 1-3.
Figure 6:
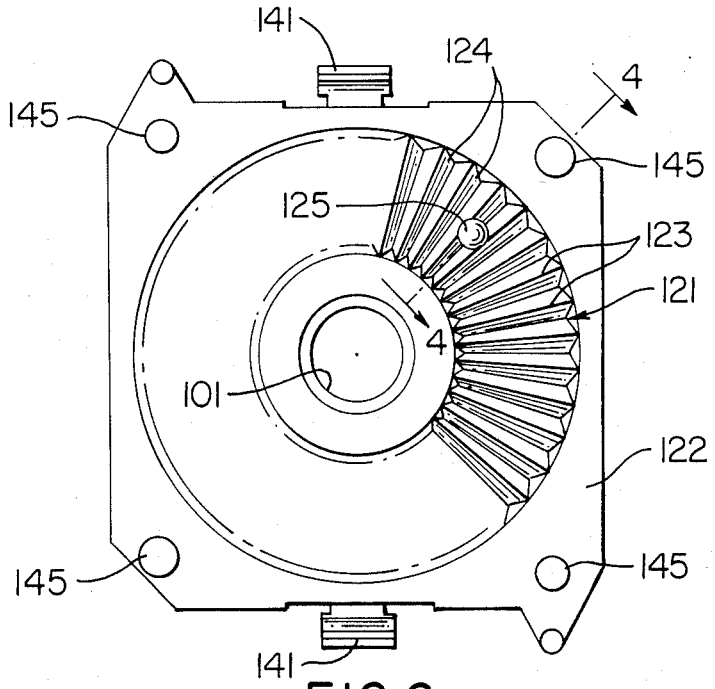
FIG. 6 is an enlarged plan view of the housing means of the switch construction and is taken generally in the direction of the arrows 6—6 of FIG. 5.

The rotary switch construction 20 of this invention has a mechanical detent means that is generally indicated by the reference numeral 120 in FIG. 4 and which is adapted to synchronize manual rotation of the selector shaft 102 to the code pattern 22 through mechanical "feel".

In particular, the detent means 120 comprises a circular detent tooth pattern 121 formed in the inside surface 122 of the closed end wall 26 of the housing member 25, the tooth pattern 121 comprising V-shaped teeth 123 that define V-shaped grooves 124 therebetween and in which a detent ball 125 is adapted to be received. The ball 125 is partially disposed in a cylindrical opening 126 formed through the disk portion 105 of the rotary shaft 102 and is urged toward the detent tooth pattern 121 by an integral leaf spring-like arm 127 of the wiper contact means 23 that extends from the body portion 65 thereof and has an end 128 biased against a pin 129 having a shank portion 130 thereof disposed in the cylindrical opening 126 of the disk portion 105 and abutting against the ball 125.

Therefore, as the shaft 102 of the selector 24 is rotated, the detent ball 125 must move from one groove 124 over an adjacent tooth 123 and back into the next adjacent groove 124 in opposition to the force of the spring leg 127 so that a decided "feel" is provided to the user of the rotary switch construction 20 and permits that user to position the wiper contact means 23 in an incremental manner relative to the code pattern 22.

Figure 9:
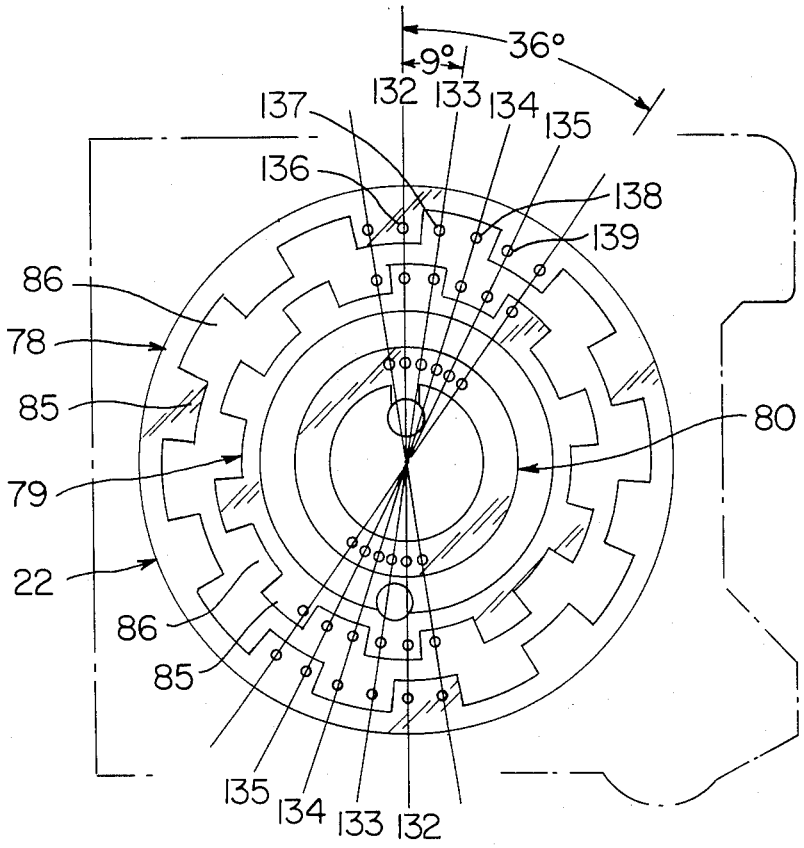
FIG. 9 is a view similar to FIG. 8 and illustrates how the code pattern of FIG. 8 operates.

In particular, the code pattern 22 illustrated in FIGS. 8 and 9 has forty distinct code variations for each 360° rotation of the shaft 102. Each of the concentric tracks or paths 78 and 79 has a 50% duty cycle of contact material 85 vs. insulating material 86 and the pattern of the paths 78 and 79 is each divided into four reference areas 132, 133, 134 and 135 as illustrated in FIG. 9. Each of these reference areas 132–135 comprises 9° of angular displacement. These four reference areas 132–135 form a repeating pattern each 36° of angular displacement which yields a total of forty distinct reference areas per 360° of angular displacement. The output of each path 78 and 79 during angular rotation provides a code pattern having two reference areas of electrically conducting material followed by two reference areas of nonconducting or insulating material as represented respectively by the reference points 136, 137, 138 and 139 in FIG. 9. As previously stated, the two paths 78 and 79 are related to each other in that the track 78 is offset relative to the track 79 by one reference area.

With such a code pattern 22 illustrated in FIG. 9 and utilizing the wiper contact means 23 of this invention, it can be seen that as the shaft 102 is angularly moved, the code path 80 will be electrically connected and disconnected with the code paths 78 and 79. This electrical continuity will conduct a reference voltage applied to the circular path 80 by terminal 89 to the terminals 87 and 88. For example, if the shaft 102 is rotated in a clockwise direction as viewed in FIGS. 7–9, so as to position the ends 73 of the wiper contacts 66–71 to contact the points 136 along the reference line 132, a conductive path is provided from the common conductive path 80 to the paths 78 and 79. At this time, the detent ball 125 is disposed in a groove 124 of the tooth pattern 121 so as to provide the "feel" necessary for aligning the contact ends 73 along the line 132. Rotating the shaft 102 of the selector 24 9° clockwise to the reference position or line 133 of FIG. 9 where the detent ball 125 is now disposed in the next adjacent groove 124 of the tooth pattern 121, it can be seen that the conductive path 80 is no longer electrically connected to the conductive path 78 while the conductive path 80 is still conducting to the path 79. Rotating the shaft 102 an additional 9° to position or line 134 of FIG. 9, it can be seen that the wiper contact means 23 does not provide any electrical connection between the conductive path 80 and the two conductive paths 78 and 79. Rotating the shaft 102 another 9° to the reference position or line 135 of FIG. 9 causes the conductive path 80 to be conducting to the path 78 and non-conducting to the path 79. Further rotation of the shaft 102 in a clockwise direction will repeat the code pattern 132–135 for nine more cycles in the embodiment illustrated in FIGS. 1–9 before the wiper contact means 23 is again positioned at the reference line 132, the detent tooth pattern 121 and ball 125 providing for the "feel" necessary for aligning and holding the wiper contact ends 73 along the selected reference line throughout such 360° rotation of the selector 24.

However, it is to be understood that the number of incrementing phases of each complete rotation of the shaft 102 is dependent on the number of "on" and "off" patterns incorporated in 360°. For example, if there are ten "on" and "off" patterns for each 360° rotation of the pattern, there is a 4 to 1 multiplication and consequently there are forty distinct codes for each complete rotation of the pattern.

Since the code patterns 78 and 79 are offset, the wiper contact means 23 provides means for determining the direction of rotation of the shaft 102 depending upon whether the first path 78 or the second path 79 leads and changes from a conducting to a non-conducting condition. Such an arrangement permits the code of the code pattern 22 emitted by the rotary switch construction 20 of this invention to be supplied to a microprocessor in the form of a digital code to increment and decrement data, such as time and temperature into a microprocessor as fully set forth in the aforementioned copending patent application.

Therefore, it can be seen that the rotary switch construction 20 of this invention is to be operated by the operator merely turning the selector 24 in the desired direction relative to the housing member 25 to cause the wiper contact means 23 to have the ends 73 of the wiper contacts 66–71 respectively placed on certain portions of the respective circular paths 78–80 thereof to either electrically interconnect the common terminal 89 to one or both of the terminals 87 and 88 or to neither terminal 87 and 88 as previously set forth for the previously set forth purpose whereby a further discussion of the operation of the rotary switch construction of this invention is not necessary.

The rotary switch construction 20 of this invention is adapted to be mounted to the circuit board 31 of FIG. 2 to be electrically interconnected into the control system 29 thereof. For example, the housing member 25 can have a pair of tongues 140 provided with barbed ends 141 adapted to be snap-fitted into suitable openings (not shown) on the board 31 as illustrated in FIG. 2 with the terminal pins 88-89 being adapted to be respectively received in suitable openings (not shown) in the board 31 and be electrically interconnected to the respective conductive paths 142, 143 and 144 by soldered connections thereto or the like.

In this manner, the board means 75 of the rotary switch is disposed against the larger board means 31.

However, it is to be understood that the surface means 21 carrying the code pattern 22 of the rotary switch construction 20 of this invention can comprise part of the main circuit board 31 so that the rotary switch construction need only comprise the housing member 25, rotary selector 24 and wiper contact means 23 to be fastened to such board as the board itself provides the surface means 21.

Figure 12:
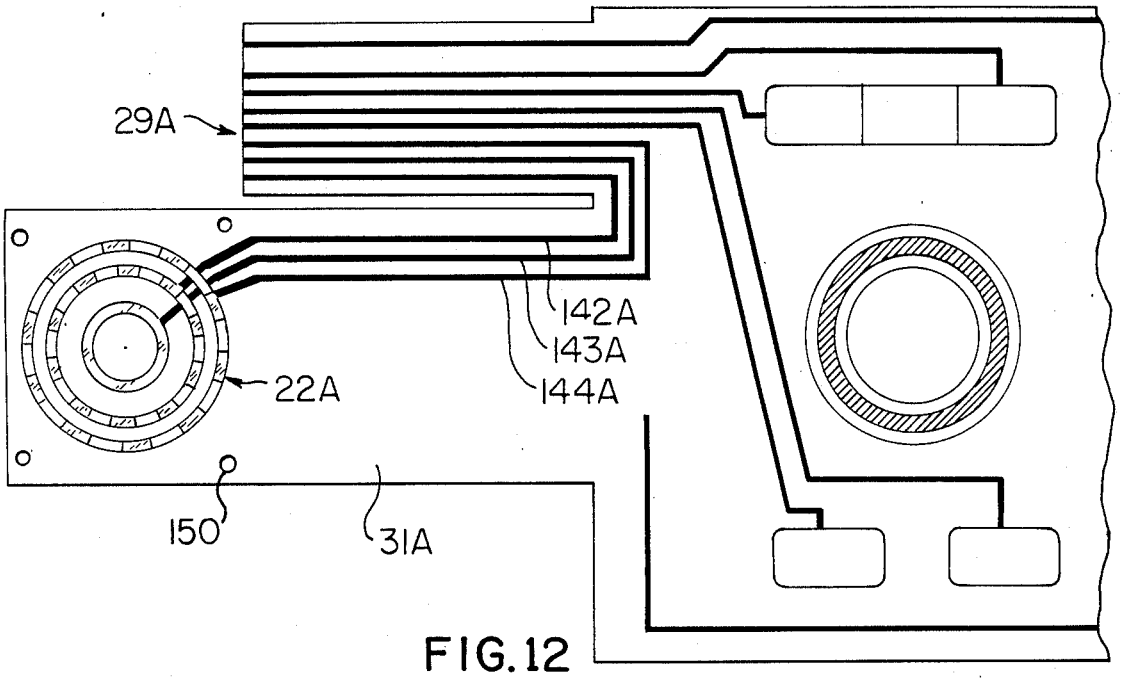
FIG. 12 is a view similar to FIG. 2 and illustrates that part of the rotary switch construction of this invention can comprise an integral portion of a larger circuit board means or membrane.

For example, reference is made to FIG. 12 wherein the circuit board 31A has the code pattern 22A disposed directly thereon and being electrically interconnected to the control circuit 29A through the conductive paths 142A, 143A and 144A thereof, the housing member 25 of the rotary switch construction 20 having the four posts 145 thereof, that normally project through the cooperating openings 145' of the board 75 to secure the same to the housing member 25, received in suitable openings 150 in the circuit board 31A.

Also, it is to be understood that the particular code pattern 22 illustrated in FIGS. 8 and 9 could be formed in a different manner while the resulting rotary switch construction will function in the same manner as previously set forth.

Figure 10:
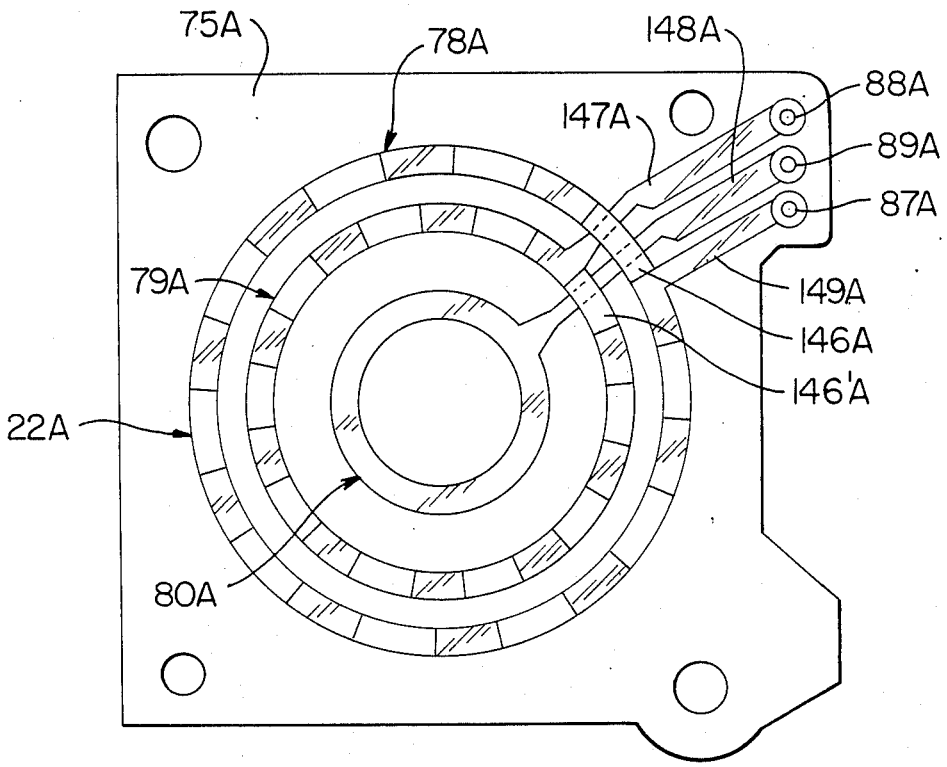
FIG. 10 is a view similar to FIG. 8 and illustrates another embodiment of the rotary switch construction of this invention.

For example, the particular code pattern 22A illustrated in FIG. 12 is illustrated in detail in FIG. 10 as being part of a circuit board 75A that is adapted to be utilized in place of the circuit board 75 of the rotary switch construction 20 previously described so that its code pattern 22A will be controlled by the wiper contact means 23 in the manner previously described.

It is believed that the code patterns of this invention can be any suitable conductive material. However, it is believed that if the same is a carbon ink, which has a vinyl base, is silk-screened onto the desired surface means, such code pattern will contribute to the improved performance of the rotary switch construction 20 of this invention because such a carbon ink is a low resistance conductor very similar to a potentiometer element. It has a smooth non-abrasive surface, which exhibits long wear characteristics and very good dynamic tracking as the wiper contacts pass over its surface. It is believed that this performance can be improved by screening the carbon ink over a deposited or plated nickel layer or coating that has itself deposited or plated on a first layer of a screened carbon layer (which provides a very low resistance code pattern and a hard long-wear surface) and also has an application of silicon lubricants on the surface of the code tracks or paths thereof. It is believed that applications requiring less than approximately 50,000 life cycles can be achieved without the nickel layer or the lubricants. The screen printed carbon ink code pattern is also an economical process and has many versatile applications.

Figure 11:
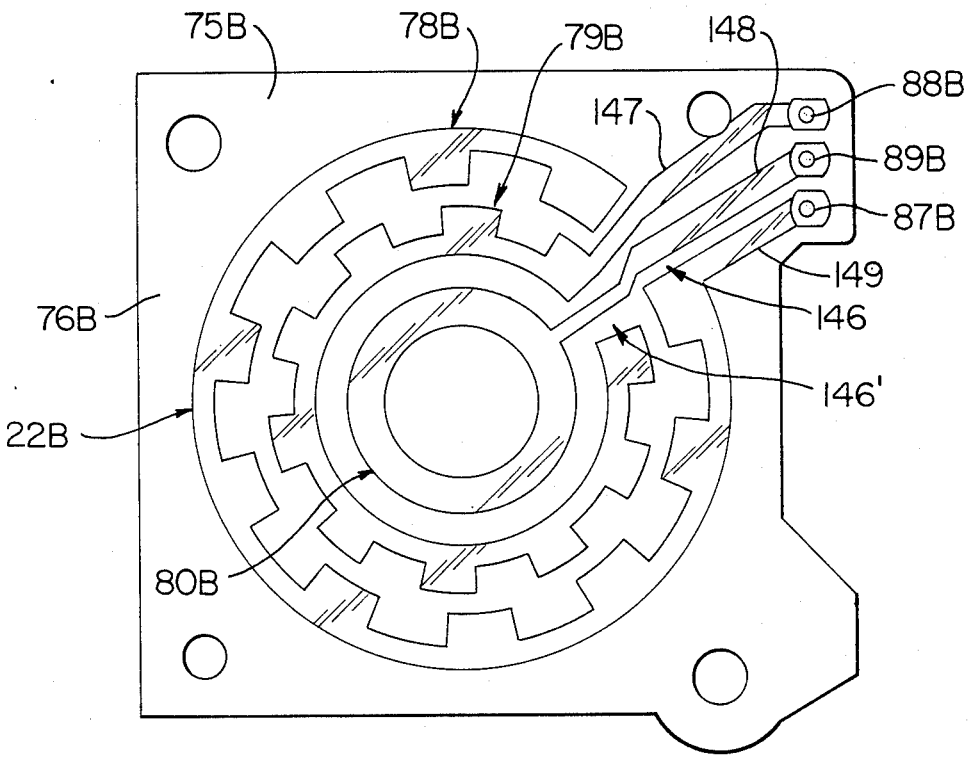
FIG. 11 is a view similar to FIG. 8 and illustrates another embodiment of the rotary switch construction of this invention.

For example, the two code patterns 22A and 22B illustrated respectively in FIGS. 10 and 11 on the board means 75A and 75B do not require a double side printing with feed through holes to interconnect the inner code tracks to their output terminals as in the board means 75 previously described.

The parts of the code patterns 22A and 22B that are similar to parts of the code pattern 22 previously described are indicated by like reference numerals followed by the reference letters "A" or "B" as the case may be.

The code pattern 22B of FIG. 11 is formed by screening the code tracks 78B and 79B with carbon ink so that each path 78B and 79B has an 18° gap in the respective code pattern as represented by the reference numerals 146 and 146' in FIG. 11. In this manner, the terminals 88B and 89B are respectively interconnected to their circular code paths 79B and 80B by conductive strips 147 and 148 disposed on the side 76B of the circuit board 75B through the gaps 146 and 146', the strip 147 being disposed within the conducting angular displacement of the code path 79B and the conductive strip 148 being disposed within the non-conducting angular displacements of paths 78B and 79B so as to prevent the wiper contacts from interconnecting the conductive paths 78B, 79B and 80B erroneously. An optional insulating mask can be screened over the conductive strips 147 and 148 for wear protection if desired. The terminal 87B is interconnected to the conductive path 78B by a conductive strip 149 disposed also on the side 76B of the board 75B.

Insulating material can also be screened over a continuous code track to form a representative code pattern of 18° conduction and 18° non-conduction as illustrated by the code pattern 22A of FIG. 10. Similar to FIG. 11, 18° gaps 146A and 146'A are used to route the interconnecting conductors 147A and 148A for the paths 79A and 80A to their respective terminals 88A and 89A. Screening insulating material over the interconnecting tracks is optional, but recommended since it is convenient. This type of screen printed code pattern is unique in that the wear characteristics are primarily dependent on the properties of the screened carbon ink and the screened insulating material and not the substrate material. This is believed to be an asset for an application similar to that illustrated in FIG. 12 which can combine the screen printed code pattern of the rotary switch on a flexible membrane keyboard substrate, such as a flexible polyester keyboard. The polyester material is a good printing substrate but may not give adequate wear performance when directly interfaced to the contacts. Thus, the polyester is overscreened with conductive and insulating materials that prevent direct mechanical interface with the wiper contacts. This also may include a screen printed hard nickel conductor under the screened carbon ink.

When such a membrane similar to 31A is utilized, the flexible tail of the polyester code pattern substrate is inserted between the wiper contact means 23 of the rotary switch construction 20 of this invention and a backplate replacing the member 75 but forming a rigid member behind such tail portion. Such polyester code pattern substrate can have four pilot holes, such as holes 150 illustrated in FIG. 12, which are registered to the screen printed code pattern thereon and will receive the four fastening pins 145 of the housing member 25 which register the code pattern to the housing member 25, shaft 102 and wiper contact means 23. Thus, the inserted flexible polyester code pattern substrate will provide a function operation similar to the description of the rotary switch construction 20 previously described. There are may advantages of a combination of a membrane keyboard and a rotary switch construction. For example, such a combination is economical and provides a convenient means of interfacing a multiplicity of such combinations to a standardized control via a membrane keyboard connector.

In any event, it can be seen that this invention provides a new rotary switch construction and a new method of making such a rotary switch construction.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In a rotary switch construction comprising a surface means having a substantially circular electrically conductive code pattern thereon, an electrically conductive wiper contact means cooperating with said surface means for making contact with a selected part of said pattern, and a rotary selector operatively associated with said surface means and said wiper contact means for selecting the desired part of said pattern that is to be contacted by said wiper contact means, the improvement wherein said wiper contact means comprises a first pair of electrically connected wiper contacts disposed to respectively contact said pattern on a first substantially circular path thereof at points thereon that are disposed approximately 180° from each other, a second pair of electrically connected wiper contacts disposed to respectively contact said pattern on a second substantially circular path thereof at points thereon that are disposed approximately 180° from each other, and a third pair of electrically connected wiper contacts disposed to respectively contact said pattern on a third circular path thereof at points that are disposed approximately 180° from each other, said wiper contact means comprising a body portion, each wiper contact having opposed ends one of which is connected to said body portion and the other of which engages said code pattern, each wiper contact of the respective pair thereof extending from said body portion in a direction substantially opposite to the extending direction of the other wiper contact of that respective pair thereof, said other ends of said wiper contacts being substantially aligned on a diameter of said circular code pattern with one of the pairs of wiper contacts having each wiper contact thereof extending in a direction substantially opposite to the extending direction of said wiper contacts of the other pairs thereof that are disposed on the same side of said diameter of said circular code pattern therewith.

2. A rotary switch construction as set forth in claim 1 wherein said circular paths of said code pattern are spaced from each other and are substantially concentrically disposed relative to each other.

3. A rotary switch construction as set forth in claim 1 wherein said wiper contact means is rotatable relative to said surface means, said rotary selector being operatively interconnected to said wiper contact means to rotate the same relative to said surface means.

4. A rotary switch construction as set forth in claim 3 wherein said circular code pattern has a center point, said wiper contact means having an axis of rotation that substantially coincides with said center point of said code pattern.

5. A rotary switch construction as set forth in claim 3 wherein each wiper contact has an arm extending between and connected to said opposed ends thereof, said arm of each wiper contact acting as a spring means to maintain said other end thereof in contact with said code pattern with a certain spring force.

6. A rotary switch construction as set forth in claim 5 wherein said arm of each wiper contact is arcuate between said opposed ends thereof and defines an arc that is substantially superimposed on its respective circular path of said code pattern.

7. A rotary switch construction as set forth in claim 6 wherein said wiper contacts are integral with said body portion and thereby define a one-piece structure therewith.

8. A rotary switch construction as set forth in claim 7 and further comprising a cup-shaped housing member having a closed end and an open end, said surface means being secured to said housing member and closing said open end thereof.

9. A rotary switch construction as set forth in claim 8 wherein said closed end of said housing member has means that rotatably mounts said rotary selector thereto, said wiper contact means being disposed in said housing member between said closed end thereof and said surface means.

10. A rotary switch construction as set forth in claim 9 wherein said surface means comprises part of a circuit board means that extends beyond said housing member.

11. In a method of making a rotary switch construction comprising the steps of forming a surface means having a substantially circular electrically conductive code pattern thereon, forming an electrically conductive wiper contact means to cooperate with said surface means so as to make contact with a selected part of said pattern, and operatively associating a rotary selector with said surface means and said wiper contact means for selecting the desired part of said pattern that is to be contacted by said wiper contact means, the improvement comprising the steps of forming said wiper contact means to comprise a first pair of electrically connected wiper contacts disposed to respectively contact said pattern on a first substantially circular path thereof at points thereon that are disposed approximately 180° form each other, forming said wiper contact means to comprise a second pair of electrically connected wiper contacts disposed to respectively contact said pattern on a second substantially circular path thereof at points thereon that are disposed approximately 180° from each other, forming said wiper contact means to comprise a third pair of electrically connected wiper contacts disposed to respectively contact said pattern on a third circular path thereof at points that are disposed approximately 180° from each other, forming said wiper contact means to comprise a body portion, forming each wiper contact to have opposed ends one of which is connected to said body portion and the other of which engages said code pattern, and forming each wiper contact of the respective pair thereof to extend from said body portion in a direction substantially opposite to the extending direction of the other wiper contact of that respective pair thereof, said steps of forming said wiper contacts forming said other ends of said wiper contacts to be substantially aligned on a diameter of said circular code pattern with one of the pairs of wiper contacts having each wiper contact thereof extending in a direction substantially opposite to the extending direction of said wiper contacts of the other pairs thereof that are disposed on the same side of said diameter of said circular code pattern therewith.

12. A method of making a rotary switch construction as set forth in claim 11 and including the step of forming said circular paths of said code pattern to be spaced from each other and to be substantially concentrically disposed relative to each other.

13. A method of making a rotary switch construction as set forth in claim 11 and including the steps of forming said wiper contact means to be rotatable relative to said surface means, and operatively connecting said rotary selector to said wiper contact means to rotate the same relative to said surface means.

14. A method of making a rotary switch construction as set forth in claim 13 and including the steps of forming said circular code pattern to have a center point, and forming said wiper contact means to have an axis of rotation that substantially coincides with said center point of said code pattern.

15. A method of making a rotary switch construction as set forth in claim 11 and including the steps of forming each wiper contact to have an arm extending between and connected to said opposed ends thereof, and forming said arm of each wiper contact to act as a spring means to maintain said other end thereof in contact with said code pattern with a certain spring force.

16. A method of making a rotary switch construction as set forth in claim 15 and including the step of forming said arm of each wiper contact to be arcuate between said opposed ends thereof and define an arc that is substantially superimposed on its respective circular path of said code pattern.

17. A method of making a rotary switch construction as set forth in claim 16 and including the step of forming said wiper contacts to be integral with said body portion and thereby define a one-piece structure therewith.

18. A method of making a rotary switch construction as set forth in claim 17 and including the steps of forming a cup-shaped housing member to have a closed end and an open end, and securing said surface means to said housing member to close said open end thereof.

19. A method of making a rotary switch construction as set forth in claim 18 and including the steps of rotatably mounting said rotary selector to said closed end of said housing member, and disposing said wiper contact means in said housing member between said closed end thereof and said surface means.

20. A method of making a rotary switch construction as set forth in claim 19 and including the step of forming said surface means to comprise part of a circuit board means that extends beyond said housing member.

* * * * *